United States Patent [19]

Kablaoui

[11] 4,231,758

[45] Nov. 4, 1980

[54] MOTOR FUEL COMPOSITION

[75] Inventor: Mahmoud S. Kablaoui, Wappingers Falls, N.Y.

[73] Assignee: Texaco Inc., White Plains, N.Y.

[21] Appl. No.: 698,436

[22] Filed: Jun. 21, 1976

[51] Int. Cl.[3] ..... C10L 1/22

[52] U.S. Cl. ..... 44/71; 44/70

[58] Field of Search ..... 44/71, 70, 58

[56] References Cited

U.S. PATENT DOCUMENTS

| | | | |
|---|---|---|---|
| 2,844,449 | 7/1958 | Dille et al. | 44/70 |
| 3,773,479 | 11/1973 | Dorn et al. | 44/71 |
| 3,901,665 | 8/1975 | Polss | 44/58 |
| 3,909,214 | 9/1975 | Polss | 44/58 |

*Primary Examiner*—Winston A. Douglas
*Assistant Examiner*—Mrs. Y. Harris-Smith
*Attorney, Agent, or Firm*—Carl G. Ries; Robert A. Kulason; James J. O'Loughlin

[57] ABSTRACT

Motor fuel composition comprising a mixture of hydrocarbons in the gasoline boiling range containing in combination a minor amount of a substituted asparagine containing the formula:

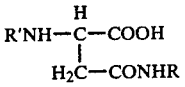

in which R and R′ each represent a secondary or tertiary alkyl or alkylene radical having from about 7 to about 20 carbon atoms and a minor amount of a carbonic acid ester having the formula:

$$R'O(CH_2CH_2O)_nOCO-(RO)_x-CO(OCH_2CH_2)_nOR'$$

in which R is a divalent aliphatic hydrocarbon radical, containing 2 to 10 carbon atoms, R′ is hydrogen or an aliphatic hydrocarbon radical containing 2 to 18 carbon atoms, x has a value from 1 to 4 and n has a value from 0 to 4.

9 Claims, No Drawings

MOTOR FUEL COMPOSITION

BACKGROUND OF THE INVENTION

1. Field of the Invention

Modern internal combustion engine design is undergoing important changes to meet stricter standards concerning engine and exhaust gas emissions. A major change in engine design recently adopted is the feeding of blow-by gases from the crankcase zone of theengine into the intake air supply to the carburetor just below the throttle plate, rather than venting these gases to the atmosphere as in the past. The blow-by gases contain substantial amounts of deposit-forming substances and are known to form deposits in and around the throttle plate area of the carburetor. These deposits restrict the flow of air through the carburetor at idle and at low speeds so that an overrich fuel mixture results. This condition produces rough engine idling, promotes stalling and also results in excessive hydrocarbon exhaust emissions to the atmosphere.

2. Description of the Prior Art

U.S. Pat. No. 3,773,479 discloses a detergent motor fuel composition containing a substituted asparagine as the effective detergent and its disclosure is incorporated herein.

U.S. Pat. No. 2,844,449 and 2,844,450 disclose motor fuel compositions containing glycol carbonates which are effective for reducing engine deposits in the combustion zone of an engine and their disclosure are incorporated herein.

SUMMARY OF THE INVENTION

A novel motor fuel composition has been discovered which exhibits enhanced carburetor detergency properties due to an unexpected cooperation found in the combination of certain additive components. While one of the components, a substituted asparagine, is a well known carburetor detergent, the other additive, acarbonate acid ester, exhibits no effectiveness as a carburetor detergent.

DESCRIPTION OF THE PREFERRED EMBODIMENTS

The substituted asparagine of the invention is represented by the formula:

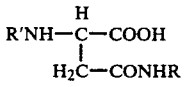

in which R and R' each represent a secondary or tertiary alkyl or alkylene radical having from 7 to 20 carbon atoms. In a more preferred embodiment, R and R' represent the same or different secondary alkyl or alkylene radicals having from 12 to 18 carbon atoms. The substituted asparagines are prepared by the reaction of maleic anhydride with a suitable amine according to the following reaction steps:

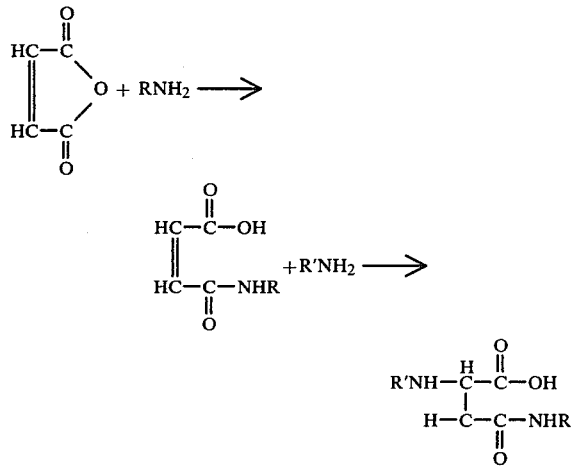

In general a mole of suitable secondary or tertiary hydrocarbyl amine is reacted with maleic anhydride at a moderate temperature preferably dissolved in an organic solvent, such as benzene. Following the initial reaction step the reaction mixture is cooled to temperatures of about 50° C. or below and another mole of the hydrocarbylamine added to the reaction mixture. On the completion of this addition, the temperature of the reaction mixture is raised to the refluxtemperature of the solvent and the mixture refluxed for an extended period until the reaction is complete. Examples of substituted asparagines which are the basic detergent additive in the present invention include:

N,N'-di-$C_{14}$-$C_{15}$ secondaryalkyl asparagine
N,N'-di-$C_{10}$-$C_{14}$ secondary alkyl asparagine
N,N'-di-$C_{15}$-$C_{20}$ secondary alkyl asparagine
N,N'-di-$C_7$-$C_9$ secondary alkyl asparagine
N-sec.-octyl,N'-sec. lauryl asparagine
N-sec. nonyl,N'-sec. octadecyl asparagine
N,N'-di-$C_{12}$ tertiary alkyl asparagine
N,N'-di-$C_{18}$ tertiary alkyl asparagine
N-$C_{14-15}$ sec. alkyl-N'-$C_{12}$ tertiary alkyl asparagine
N-$C_{12-14}$ tert. alkyl-N'-$C_{18-22}$ tert. alkyl sparagine
N,N'-di-$C_{11}$-$C_{14}$ sec. alkyl asparagine The carbonic acid ester compound employed in the fuel composition of the invention is represented by the formula:

$$R'O(CH_2CH_2O)_nOCO—(RO)_x-CO(OCH_2CH_2)_nOR'$$

in which R is a divalent aliphatic hydrocarbon radical, containing 2 to 10 carbon atoms, R' is hydrogen or an aliphatic hydrocarbon radical containing 2 to 18 carbon atoms, x has a value from 1 to 4 and n has a value from 0 to 4.

Carbonic acid ester compounds which exhibit no carburetor detergency properties when employed in a motor fuel composition yet which surprisingly cooperate with the substituted asparagine to enhance its carburetor detergency include diethyleneglycol-bis-2-ethoxyethyl carbonate and diethyleneglycol-bis-hexyl carbonate.

Other carbonic acid ester compounds which are suitable for the present invention include ethylene glycol bis (ethoxyethyl carbonate), ethylene glycol bis (n-2-butoxy-ethyl carbonate), ethylene glycol bis (pentoxyethyl carbonate) ethylene glycol bis (decoxyethyl carbonate), diethylene glycol bis (ethoxyethyl carbonate), diethylene glycol bis (propoxyethyl carbonate), diethylene glycol bis (hexoxyethyl carbonate), diethylene glycol bis (octoxy-ethyl carbonate), propylene glycol bis (butoxyethyl carbonate), dipropylene glycol bis (ethoxyethyl carbonate), diethylene glycol bis (pentoxyethyl carbonate), tetraethylene glycol bis(ethoxyethyl carbonate), tri-ethylene glycol bis (butoxy-ethyl carbonate), tetraethylene glycol bis (propoxyethyl carbonate), triethylene glycol bis (octoxyethyl carbonate), triethylene glycol bis (butoxyethyl crbonate), diethylene glycol (bis-n-pentoxyethoxyethyl carbonate) and tetraethylene glycol bis (2-ethylhexoxyethyl carbonate).

The motor fuel composition of the invention comprises a mixture of hydrocarbons boiling in the gasoline boiling range i.e. generally from about 85° to 450° F.

The gasoline motor fuel which is benefitted by the novel detergent additive combination of the invention may be leaded or unleaded and may consist of straight chain orbranched-chain paraffins, cycloparaffins, olefins and aromatic hydrocarbons and mixtures of these. The base fuel can be derived from straight run naphtha, polymer gasoline, natural gasoline or froom catalytically cracked or thermally cracked hydrocarbons and catalytically reformed stocks. The hydrocarbon composition and the octane level of the base fuel are not critical. Any conventional motor fuel base may be employed in the practice of this invention.

In general, the additive components of the invention are added to a fuel composition in minor amounts, i.e., amounts effective to cooperate in providing the enhanced detergency of the fuel composition. The substituted asparagine additive is employed in an amount ranging from about 0.001 to 5.0 weight percent based on the total fuel composition with an amount ranging from about 0.001 to 0.2 weight percent being preferred. The most effective concentration of this additive component ranges from about 0.002 to 0.10 weight percent.

The carbonate acid ester compound which was discovered to cooperate with the substituted asparagine compound is employed in an amount ranging from about 0.01 to 0.05 volume percent of the finished fuel composition. The preferred concentration of this additive component is from about 0.05 to 0.25 volume percent of the gasoline composition.

A fuel composition containing the additive combination of the invention can contain other additives normally employed in a gasoline motor fuel composition. For example, the base fuel may be blended with an anti-knock compound, such as tetraalkyl lead compound, including tetraethyl lead, tetramethyl lead, tetrabutyl lead, or mixtures thereof generally in a concentration from about 0.01 to 4.0 cc. per gallon of gasoline. The tetraethyl lead mixture commercially available for automotive use will also contain an ethylene chloride-ethylene bromide mixtures as scavenger for removing lead combustion products from the engine. The fuel composition may also be augmented with anit-icing additives, corrosion inhibitors, dispersants and upper cylinder lubricants.

The additive combination of the invention was tested for its effectiveness as a carburetor detergent in the Buick Carburetor Detergency Test. This test is run on a Buick 350 CID V-8 Engine equipped with a two-barrel carburetor. The engine is mounted on a test stand and has operating EGR and PCV systems. The test cycle, shown in Table I, is representative of normal road operation. Approximately 300 gallons of fuel and three quarts of oil are required for each run.

Prior to each run the carburetor is completely reconditioned. Upon completion of the run, the throttle plate deposits and the deposits on the area below the throttle plate are visually rated according to a CRC Varnish rating scale (Throttle Plate Merit Rating) where a rating of (1) one describes heavy deposits on the throttle plate and a rating of (10) ten a completely clean plate. The two ratings are averaged to give an average carburetor rating.

TABLE I

1973 BUICK CARBURETOR DETERGENCY TEST OPERATING CONDITIONS

| | Stage I | Stage II | Stage III |
|---|---|---|---|
| Duration, hour | 1 | 3 | 1 |
| Speed, r.p.m. | 650 + 25 | 1500 + 25 | 2000 + 25 |
| Torque, ft. lbs. | 0 | 80 + 2 | 108 + 2 |
| Water Out, °F. | 205 + 5 | 205 + 5 | 205 + 5 |
| Carburetor Air, °F. | 140 + 5 | 140 + 5 | 140 + 5 |
| Exhaust Back Pres. in Hg. | — | 0.7 + 0.1 | — |
| Man. Vac., In Hg. | 18–20 | 14–17 | 11–13 |
| Fuel Flow, lbs/hr. | ~4 | ~14 | ~20 |
| Test Duration, 120 hours | | | |

The fuel composition employed for testing the detergent additive combination of the invention was an unleaded gasoline base fuel having a Research Octane Number of 96. This gasoline consisted of about 23% of aromatic hydrocarbons, 12% olefinic hydrocarbons and 65% paraffinic hydrocarbons and boiled in the range from 94° to 377° F.

Test results obtained employing the detergent additive combination of the invention and comparison test results are given in the Table below.

TABLE II

BUICK CARBURETOR DETERGENCY TEST

| Run | Fuel | Carburetor Rating |
|---|---|---|
| 1. | Unleaded Base Fuel | 3.0 |
| 2. | Unleaded Base Fuel + PTB N,N'-di-$C_{15}$–$C_{20}$ secondary alkyl asparagine[2] | 5.0 |
| 3. | Unleaded Base Fuel + 200 PTB of diethylene-bis-2-ethoxyethyl carbonate | |
| 4. | Unleaded Base Fuel + 15 PTB N,N'-di-$C_{15}C_{20}$ secondary alkyl asparagine + 200 PTB diethyleneglycol-bis-2-ethoxyethyl carbonate[2] | 6.4 |
| 5. | Unleaded Base Fuel + 15 PTB N,N'-di-$C_{15}$–$C_{20}$ secondary alkyl asparagine + 200 PTB diethyleneglycol-bis-hexyl carbonate[2] | 6.3 |

(1)PTB = Pounds of additive per 1000 barrels of fuel (2)These fuels also contained 18 PTB of a corrosion inhibitor and 43 PTB of a carrier mineral oil.

Run 3 shows that a carbonate acid ester has absolutely no effect on the carburetor detergency of a motor fuel composition. In contrast, Runs 4 and 5, containing a carbonate acid ester in combination with a substituted asparagine provided a substantial improvement in carburetor detergency over Run 2 which contained the substituted asparagine without the carbonate acid ester. These results were unexpected in view of the absence of carburetor detergency in carbonate acid ester alone.

I claim:

1. A motor fuel composition comprising a mixture of hydrocarbons in a gasoline boiling range containing from about 0.001 to 5.0 weight percent of a substituted asparagine having the formula:

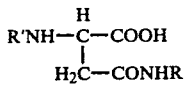

in which R and R′ each represent a secondary or a tertiary alkyl or alkylene radical having from about 7 to 20 carbon atoms and from about 0.01 to 0.05 volume percent of a carbonic acid ester having the formula:

$$R'O(CH_2CH_2O)_nOCO-(RO)_x-CO(OCH_2CH_2)_nOR'$$

in which R is a divalent aliphatic hydrocarbon radical containing 2 to 3 carbon atoms, R′ is hydrogen or an aliphatic hydrocarbon radical containing 2 to 18 carbon atoms, x has a value from 1 to 4 and n has a value from 0 to 4.

2. A motor fuel composition according to claim 1 in which R and R′ in said substituted asparagine represent secondary hydrocarbyl radicals.

3. A motor fuel composition according to claim 1 in which said substituted asparagine is N,N′-di-$C_{15}$-$C_{20}$ secondary alkyl asparagine.

4. A motor fuel composition according to claim 1 in which said substituted asparagine is N,N′-di-$C_{11}$-$C_{14}$ secondary alkyl asparagine.

5. A motor fuel composition according to claim 1 in which said carbonic acid ester is a glycolbis (glycol ether carbonate).

6. A motor fuel composition according to claim 1 in which said carbonic acid ester is diethylene glycol-bis-2-ethoyethyl carbonate.

7. A motor fuel composition according to claim 1 in which said carbonic acid ester is diethyleneglycol-bis-hexyl carbonate.

8. A motor fuel composition according to claim 1 containing from about 0.001 to 0.2 weight percent of said substituted asparagine and from about 0.05 to 0.25 volume percent of said carbonate acid ester.

9. A motor fuel composition according to claim 1 in which said hydrocarbon mixture boils in the range from about 85° to 450° F.

* * * * *

UNITED STATES PATENT AND TRADEMARK OFFICE

CERTIFICATE OF CORRECTION

PATENT NO. : 4,231,758

DATED : November 4, 1980

INVENTOR(S) : Mahmoud S. Kablaoui

It is certified that error appears in the above—identified patent and that said Letters Patent is hereby corrected as shown below:

Column 5, line 8, "0.05" should read --0.5--.

Signed and Sealed this

*Eleventh* Day of *August 1981*

[SEAL]

*Attest:*

GERALD J. MOSSINGHOFF

*Attesting Officer* *Commissioner of Patents and Trademarks*